United States Patent [19]

Berthelot

[11] 4,133,523

[45] Jan. 9, 1979

[54] STACKING DEVICE FOR SHEETS

[75] Inventor: Daniel Berthelot, Montluel, France

[73] Assignee: S. A. Martin, Villeurbanne, France

[21] Appl. No.: 811,672

[22] Filed: Jun. 29, 1977

[30] Foreign Application Priority Data

Jul. 9, 1976 [FR] France ..... 76 21112

[51] Int. Cl.[2] ..... B65H 29/16; B65H 29/66

[52] U.S. Cl. ..... 271/182; 93/93 DP; 271/202; 271/215

[58] Field of Search ..... 271/182, 183, 191, 200, 271/201, 202, 203, 256, 229, 69, 216, 215, 73, 67, 198, 199; 93/93 DP, 93 HT, 93 R; 198/425, 422

[56] References Cited

U.S. PATENT DOCUMENTS

| | | | |
|---|---|---|---|
| 3,724,840 | 4/1973 | Kuckhermann | 271/182 |
| 3,911,800 | 10/1975 | Feldkamper | 271/182 X |
| 3,938,674 | 2/1976 | Kroeze et al. | 271/201 X |

*Primary Examiner*—Bruce H. Stoner, Jr.

*Attorney, Agent, or Firm*—Haseltine, Lake & Waters

[57] ABSTRACT

A device for stacking sheets from the output of a machine for producing sheets, the device comprising a conveyor system feeding the sheets to a stack forming station, the conveyor system comprising first and second conveyors of which the first conveyor has a telescopic discharge portion which is retracted relative to the second conveyor during the period in which a formed stack is discharged from the stack forming station, to lay sheets on the second conveyor. The second conveyor moves at a reduced or zero linear speed while the speed of the first conveyor remains unchanged.

4 Claims, 3 Drawing Figures

STACKING DEVICE FOR SHEETS

FIELD OF THE INVENTION

The present invention is concerned with a device for stacking sheets from a manufacturing or processing machine. It is particularly, but not exclusively, applicable to receiver stations at the end of a "corrugator" or train of machines for the production of sheets from a continuous band of corrugated cardboard, the band being cut up into sheets by both longitudinal and transverse shearing of the continuous band being manufactured upstream.

PRIOR ART

The problem of receiving and discharging sheets cut up by the corrugator is an important problem which often constitutes a limit to the production of this machine.

Many corrugators at present in service have a semi-automatic receiver station in which elementary stacks of sheets are formed, these stacks being discharged transversely and then formed manually into bigger stacks which are transferred to the fabricating workshops.

To increase the output flow of sheets it has been possible to arrive at more automatic formation of the stacks from elementary stacks discharged transversely, by employing continuous stackers with belt conveyors, which have relative movement of the head of the conveyor and the top of the stack being formed. In such stackers either the slope of the conveyor increases progressively as the stack height increases, or the conveyor is fixed and the bottom support for the stack sinks with the increase in height of the stack, in both cases under the control of a photoelectric cell which registers the top portion of the stack being formed.

More direct devices have also been produced, in which stacking is effected on the axis of the corrugator and without the intermediate formation of elementary stacks by transverse discharge.

In all these automatic devices it is obviously necessary to interrupt the stacking periodically in order to discharge the stack which has been formed. As it is impossible to conceive of stopping operation of the corrugator during this dead period, it is necessary to stop temporarily the discharge of the sheets by, for example, lowering a flap which holds back the sheets on the conveyor; the sheets which already normally overlap one another on the conveyor then pile up against the stop formed by the flap, under the thrust of the belts which continue to run. The result is a deformation of the alignment of the sheets because the least unevenness or dissymmetry in a sheet leads to its being more or less on the cross, which upsets the alignment of the following sheets. When the flap is opened again to form another stack the whole of the bottom of the stack is misshapen and it is necessary to intervene manually in order to straighten it out. Good alignment of the stacks is very important because more and more these stacks are employed directly in automatic feed stations on fabricating machines.

Stacking devices are also known which have two conveyors in series, in which during stack changes stoppage of the discharge of sheets by means of a stop-flap is combined with stoppage of the second downstream conveyor. In this case the upstream conveyor continues to discharge the sheets, forming them into a local stack on the stationary second conveyor. The stationary conveyor may be given a slight sinking motion in order to "make way" for other sheets which come and accumulate on it. But at the time of starting up again a relatively large stack will be discharged onto the stack formation location all at once, which again presents grave risks of misalignment of the stack being formed.

SUMMARY OF THE INVENTION

According to the present invention there is provided a device for stacking sheets at the output of a machine for producing sheets, the device comprising:

a stack forming station in which a stack of sheets of a predetermined height is formed and discharged;

endless conveyor means for conveying sheets from the machine to said stack forming station; means for detecting the height of a stack of sheets in said stack forming station;

means for causing relative vertical movement between the discharge end of said conveyor means and a stack of sheets in said stack forming station;

stop means at said discharge end of said conveyor means operable during discharge of a stack from said stack discharge station to prevent feed of sheets to said stack forming station;

said conveyor means including:

a first endless conveyor for receiving sheets from the machine and having a telescopic discharge end portion;

a second endless conveyor extending from said discharge end of said first conveyor to feed sheets to said stack forming station; and means for moving said telescopic end portion of said first conveyor to move said discharge end of said first conveyor between two extreme positions above said second conveyor;

drive means for driving said first and second conveyors at a first linear speed which is less than, but in a constant ratio to, the speed of the machine during formation of a stack in said stack forming station, and for driving said second conveyor at a second reduced speed during discharge of a stack from said stack forming station; and means for causing, at the beginning of a stack discharge operation, operation of said stop, reduction in the speed of said second conveyor, and for initiating retraction movement of said telescopic portion of said first conveyor at a speed such that the period of said retraction movement is at least equal to the period of a stack discharge operation, and, at the beginning of each stack formation operation, for initiating return movement of said telescopic portion of said first conveyor and increasing the linear speed of said second conveyor to said first speed.

Preferably the linear speed of said second conveyor is reduced to zero during a stack discharge operation.

BRIEF DESCRIPTION OF THE DRAWINGS

The invention will be more fully understood from the following description of an embodiment thereof, given by way of example only, with reference to the accompanying drawings.

In the drawings.

DETAILED DESCRIPTION

Figure 1:
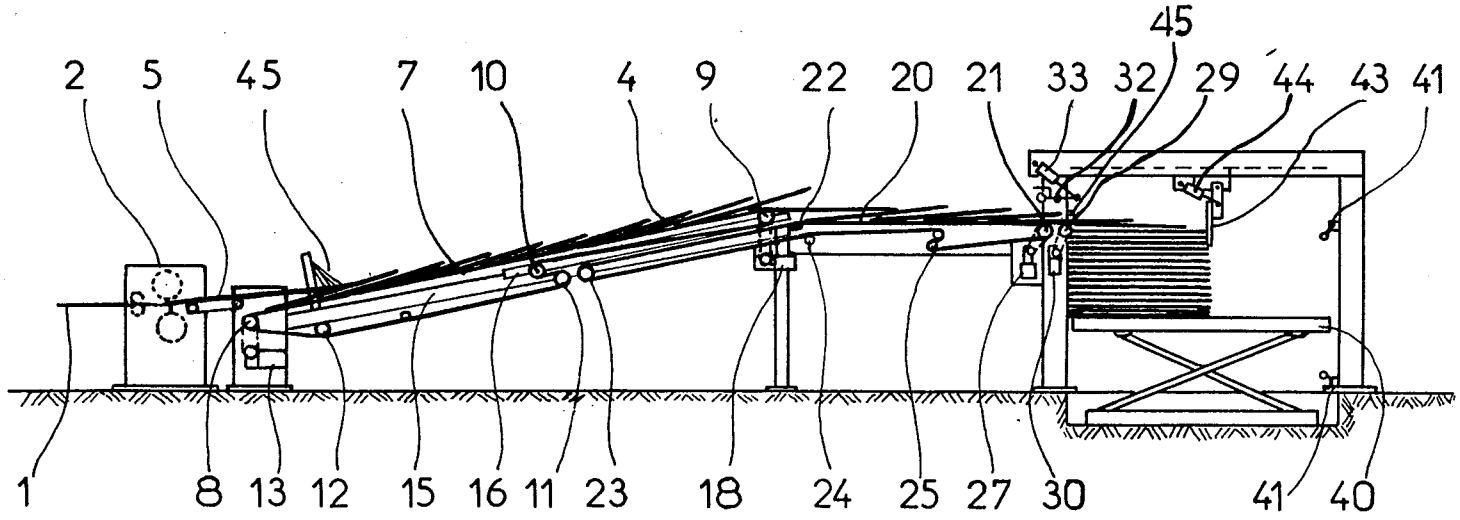
FIG. 1 is a simplified elevation view of an embodiment of a stacking device in accordance with the invention.

Referring to the drawings, FIG. 1 shows the end of a corrugator for the production of sheets of corrugated cardboard. The continuous band 1 of corrugated cardboard manufactured upstream and, if necessary, slit longitudinally passes into a transverse cutter 2. The sheets 4 thus cut up are discharged from the cutter by an intermediate belt 5 which discharges them onto a first endless conveyor 7 of the stacker device. The conveyor 7 comprises, for example, endless belts placed side by side, which belts pass in succession over driving pulleys 8, a discharge pulley 9 and guide pulleys 10, 11 and 12. the conveyor is driven from a geared motor unit 13 controlled from the general driving train of the corrugator so as to ensure a constant ratio less than 1 between the linear speed of the conveyor 7 and the speed of the continuous band 1.

Of course, the conveyor 7 also includes tensioner devices of usual type which have not been shown in order to simplify the drawing.

The conveyor 7 is supported by a main fixed framework 15 upon which slides a telescopic portion 16. The pulleys 8, 11 and 12 are mounted on the fixed framework and the pulleys 9 and 10 are mounted on the telescopic portion 16 of the framework. The portion 16 is moved by a geared motor unit 18 via known mechanical devices such as, for example, a chain system, which has not been shown in FIG. 1 because its concept is within the scope of an average technician.

The sheets 4 arriving at the pulley 9 at the discharge end of the conveyor 7 fall onto a second endless conveyor 20 consisting, for example, as the first conveyor, of a group of parallel endless belts. The belts of the conveyor 20 are wrapped round driving pulleys 21 at the end and guide pulleys 22, 23 and 24. A tension regulator device 25 is shown symbolically. Motion of the driving pulleys 21 is provided by a geared motor unit 27 which, when running normally, drives the second conveyor at the same linear speed as the first conveyor.

A rubber-covered roller 29 is arranged just beyond the end pulleys 21 of conveyor 20 and is driven by a constant-speed motor 30 at a linear velocity greater than the velocity of the conveyors 7 and 20 so as to be able to discharge correctly the sheets delivered by the conveyor 20. Above the roller 19 is a flap 32 operated by a pneumatic jack 33 so that, during normal running, the flap is raised and permits the sheets to pass, but, during stack-change, the flap 28 moves down and presents an obstacle to the passage of the sheets.

The flap 32 includes a stop-plate 34 (FIG. 2) and an idler roller 35.

The stacking station consists, as is known in this type of device, of an elevator table 40, the raising and lowering of which are effected by a hydraulic system (not shown). In an equally well known way the operation of this hydraulic device is controlled for example, by a system of photoelectric cells 45 which detect the top level of the stack under formation and control the lowering of the table as stacking of the sheets on the stack proceeds. The movement of the table 40 is limited by end-of-travel stops 41 which are adjustable in height as a function of the stacks to be formed and which detect in succession the end of the formation of a stack and the return of the table 40 into position after discharge of the previously formed stack. The automatic equipment controlling the successive cycles of movement of the table and of discharge of the stacks is well known and for this reason will not be described further. The stacking station is completed by a retractable stop 43 which is controlled by a jack 44 and the retracting motion of which forms part of the sequence of the various operations which have just been mentioned. The position of the stop 43 and its jack 44 is adjustable longitudinally according to the size of the sheets to be stacked.

Figure 2:
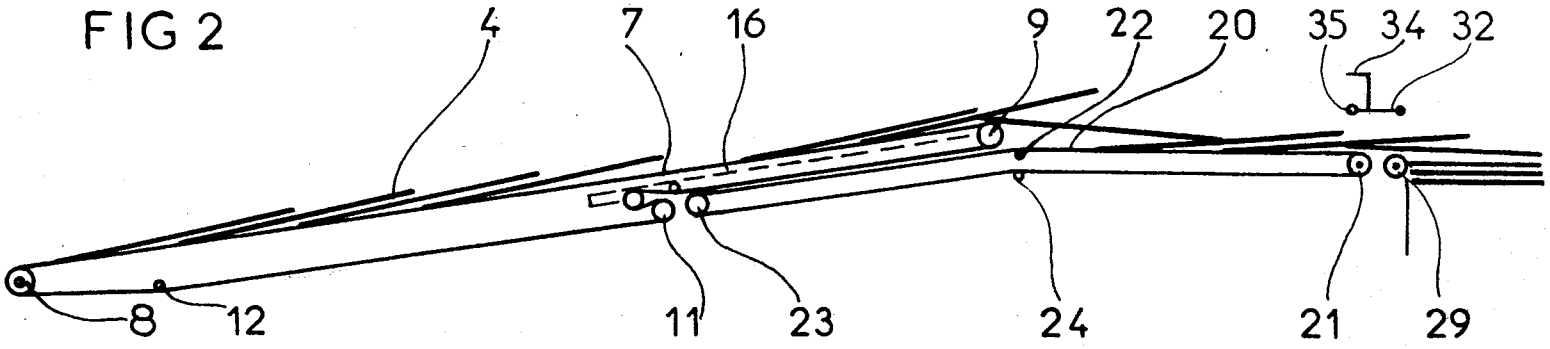
FIGS. 2 and 3 show diagrammatically the two extreme positions of the telescopic portion of the first conveyor, FIG. 2 showing the first conveyor extended and corresponding to normal operation of the stacker device during the formation of a stack and FIG. 3 showing the first conveyor in its position of maximum retraction corresponding to the situation at the end of a stack change, just before the start of the formation of another stack.
Figure 3:
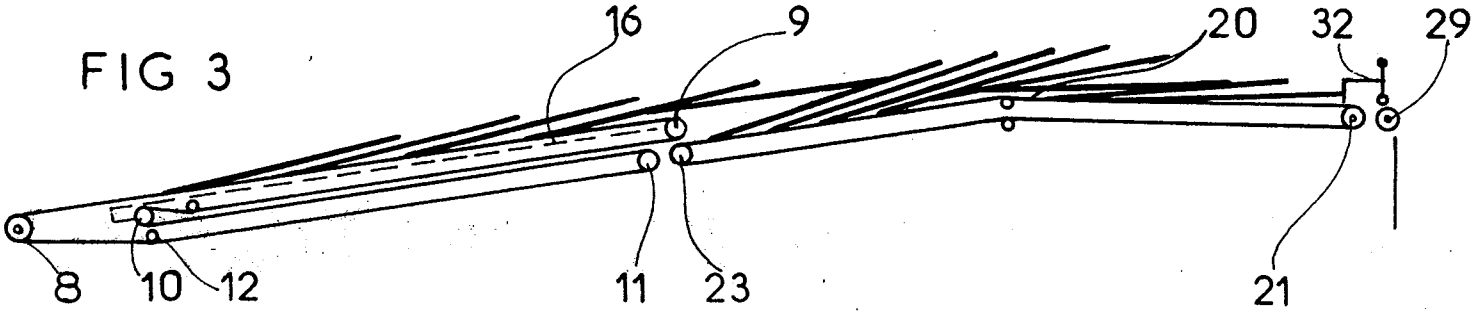

In normal operation, that is to say, during the formation of a stack such as is shown in FIG. 1 or FIG. 2, the flap 32 is raised and the conveyors 7 and 20 are being driven at the same linear velocity which is less than that of the band 1. The result of this is that the sheets, cut up by the cutter 2, overlap one another on the conveyors 7 and 20 and preserve the same overlap from one end to the other of the two conveyors.

A row of flexible brushes 45 keeps the sheets bearing against the belts of conveyor 7 during their transfer from the intermediate conveyor 5 to the conveyor 7.

When the elevator table 40 reaches the lower end-of-travel contact 41 the stack has reached its maximum height and the stack-changing cycle commences. The conveyor 20 is then stopped while the conveyor 7 continues to move at the same speed as before. At the same time the flap 32 is lowered, bringing the idler roller 35 into contact with the sheets waiting to be discharged and pressing them against the rubber-coated roller 29 to discharge them quickly. At the same time the motor 18 is started up in order to retract the telescopic portion 16 of the supporting framework of the conveyor 7. It can be seen that under these conditions the sheets 4 leave the conveyor 7 more rapidly, the latter moving away progressively under them, and are as it were "laid" on the conveyor 20 which is stationary. The sheets are laid on the conveyor 20 with an overlap greater than that of normal running, without this overlap being total, which enables the sheets cut off during the dead time of the stack change at the stacking station to be stored on the stationary conveyor 20 and over a distance corresponding with the travel in retraction of the pulleys 9. Of course, with the guide rollers 10 of the conveyor 7 being moved at the same time as the rollers 9, the developed length of the belts 7 remains constant as well as their tension.

The travel of the telescopic portion of the conveyor 7 and the speed of retraction are determined so that the stack-change has finished before the frame 16 has arrived at the end of its backward travel. During this phase of retraction, the formed stack is discharged and the elevator table is raised again to the level of the upper end-of-travel contact 41, which starts the sequences of operation leading to the formation of another stack. The flap 32 is then moved out of the way and the conveyor 20 started at the same linear velocity as the conveyor 7. Starting from the resumption of the stacking cycle, the telescopic part 16 is progressively brought towards its original forward position at a velocity which is determined so that the rollers 9 cannot overtake the sheets already laid down on the conveyor 20, which is now moving at the same velocity as that of the conveyor 7. Of course, the return travel of the telescopic frame 16 to its original position must finish before the next stack-change.

It will be observed that during the entire time of the stack-changing and of the return of the frame 16 into its original position, the velocity of the first conveyor 7 has remained the same as during normal running, which enables the overlap of the sheets on the conveyor 7 not to be modified during the stack-change, with respect to the overlap obtained in normal running. During this period the stationary conveyor 20 continues to receive sheets which are still arranged to overlap one another partially, the overlap being greater than that in normal running. Upon resumption of stacking there will still be continuity of discharge of sheets with an overlap, which enables correct stacking.

of course the invention is not intended to be strictly confined to the embodiment which has just been described by way of example, but covers embodiments which may differ from it only in detail, in variants upon the execution or in the employment of equivalent means. Thus, instead of completely stopping the conveyor 20 during the stack changes, it may be kept in very slight motion, enabling the storage capacity to be increased a little without the risk of too great shifting of the sheets, which are held immovable by the stop.

What is claimed is:

1. A device for stacking sheets at the output of a machine for producing sheets, the device comprising:

a stack forming station in which a stack of sheets of a predetermined height is formed and discharged;

endless conveyor means for conveying sheets from the machine to said stack forming station;

means for detecting the height of a stack of sheets in said stack forming station;

means for causing relative vertical movement between the discharge end of said conveyor means and a stack of sheets in said stack forming station;

stop means at said discharge end of said conveyor means operable during discharge of a stack from said stack discharge station to prevent feed of sheets to said stack forming station;

said conveyor means including:

a first endless conveyor for receiving sheets from the machine and having a telescopic discharge end portion;

a second endless conveyor extending from said discharge end of said first conveyor to feed sheets to said stack forming station; and means for moving said telescopic end portion of said first conveyor to move said discharge end of said first conveyor between two extreme positions above said second conveyor;

drive means for driving said first and second conveyors at a first linear speed which is less than, but in a constant ratio to, the speed of the machine during formation of a stack in said stack forming station, and for driving said second conveyor at a second reduced speed during discharge of a stack from said stack forming station; and means for causing, at the beginning of a stack discharge operation, operation of said stop, reduction in the speed of said second conveyor, and for initiating retraction movement of said telescopic portion of said first conveyor at a speed such that the period of said retraction movement is at least equal to the period of a stack discharge operation, and, at the beginning of each stack formation operation, for initiating return movement of said telescopic portion of said first conveyor and increasing the linear speed of said second conveyor to said first speed.

2. A device as claimed in claim 1, wherein said second linear speed of said second conveyor is zero.

3. A device as claimed in claim 1, wherein said telescopic portion of said second conveyor is returned to its extended position at a speed less than said first speed.

4. A device as claimed in claim 1, including immediately downstream of the discharge end of said second conveyor an ejector roller, and means for driving said ejector roller continuously and at a linear speed greater than said first speed.

* * * * *